US009088099B2

(12) United States Patent
Urashima et al.

(10) Patent No.: US 9,088,099 B2
(45) Date of Patent: Jul. 21, 2015

(54) CONNECTOR

(71) Applicant: YAZAKI CORPORATION, Minato-ku, Tokyo (JP)

(72) Inventors: Tomohiro Urashima, Tochigi (JP); Munetoshi Nakahara, Tochigi (JP); Yoshinori Takahashi, Tochigi (JP)

(73) Assignee: YAZAKI CORPORATION, Tokyo (JP)

( * ) Notice: Subject to any disclaimer, the term of this patent is extended or adjusted under 35 U.S.C. 154(b) by 16 days.

(21) Appl. No.: 14/154,224

(22) Filed: Jan. 14, 2014

(65) Prior Publication Data

US 2014/0127931 A1 May 8, 2014

Related U.S. Application Data

(63) Continuation of application No. PCT/JP2012/004920, filed on Aug. 2, 2012.

(30) Foreign Application Priority Data

Aug. 3, 2011 (JP) ..... 2011-170286

(51) Int. Cl.

| | |
|---|---|
| ***H01R 13/627*** | (2006.01) |
| ***H01R 13/506*** | (2006.01) |
| ***H01R 13/516*** | (2006.01) |
| *H01R 13/50* | (2006.01) |
| *H01R 13/52* | (2006.01) |

(52) U.S. Cl.

CPC ..... *H01R 13/6271* (2013.01); *H01R 13/506* (2013.01); *H01R 13/516* (2013.01); *H01R 13/501* (2013.01); *H01R 13/5213* (2013.01)

(58) Field of Classification Search

CPC ..... H01R 13/5205; H01R 13/426; H01R 13/447; H01R 13/52; H01R 13/5213; H01R 13/582; H01R 13/6275; H01R 2201/26

USPC ..... 439/272, 752, 352

See application file for complete search history.

(56) References Cited

U.S. PATENT DOCUMENTS

| | | | | |
|---|---|---|---|---|
| 5,551,892 | A * | 9/1996 | Endo et al. | 439/587 |
| 6,139,351 | A * | 10/2000 | Schaefer et al. | 439/372 |
| 6,832,922 | B2 * | 12/2004 | Kozono et al. | 439/135 |
| 8,206,171 | B2 * | 6/2012 | Osawa et al. | 439/352 |

(Continued)

FOREIGN PATENT DOCUMENTS

| | | |
|---|---|---|
| JP | 2004-220856 A | 8/2004 |
| JP | 2005-318706 A | 11/2005 |

*Primary Examiner* — Truc Nguyen

(74) *Attorney, Agent, or Firm* — Marvin A. Motsenbocker; MOTS LAW, PLLC

(57) ABSTRACT

A connector includes a temporary lock member having a mating arm provided at a connector housing and an arm mating hole provided at a cover body of a connector cover. The mating arm has an edge portion formed with a protruding portion. The arm mating hole is so configured that: in a position where the protruding portion abuts an interference inner wall face, the cover body is pressed inward while being rotated such that the cover body returns to a position where the cover body faces an inherent mounting direction of the cover body, which allows the protruding portion to get over the interference inner wall face and to be inserted to an insertion completion position; and in the insertion completion position, the arm mating hole sandwiches the protruding portion.

3 Claims, 11 Drawing Sheets

(56) References Cited

U.S. PATENT DOCUMENTS

| | | | | |
|---|---|---|---|---|
| 2003/0176090 | A1 | 9/2003 | Kozono et al. | |
| 2004/0235364 | A1* | 11/2004 | Matsumoto et al. | 439/752 |
| 2008/0280467 | A1 | 11/2008 | Tsuji | |
| 2010/0240252 | A1* | 9/2010 | Cappe et al. | 439/587 |
| 2011/0021064 | A1* | 1/2011 | Shibata et al. | 439/470 |
| 2012/0100753 | A1* | 4/2012 | Omae et al. | 439/588 |
| 2013/0102163 | A1* | 4/2013 | Basavarajappa et al. | 439/34 |
| 2013/0323953 | A1* | 12/2013 | Oshita | 439/271 |

* cited by examiner

CONNECTOR

CROSS REFERENCE TO RELATED APPLICATION

This is a continuation application based on PCT application No. PCT/JP2012/004920 filed on Aug. 2, 2012, which claims the benefit of priority from Japanese Patent Application No. 2011-170286 filed on Aug. 3, 2011, the entire contents of which are incorporated by reference herein.

BACKGROUND OF THE INVENTION

1. Field of the Invention

The present invention relates to a connector in which a connector cover and a connector housing are assembled such that the connector cover is mounted to an electric wire pulling-out side of the connector housing.

Conventionally, various types of connectors each in which a connector cover and a connector housing are assembled have been proposed so as to prevent an electric wire pulling-out portion of the connector housing from being directly subjected to water or so as to fix one end side of a corrugated tube (for example, refer to PTL 1: Japanese Patent Application Laid-Open Publication No. 2004-220856 and PTL 2: Japanese Patent Application Laid-Open Publication No. 2005-318706). An example of one type of these conventional connectors is shown in FIG. 1 to FIG. 4.

In FIG. 1 to FIG. 4, a connector 100 includes a connector housing 102, a connector cover 110 mounted to the connector housing 102, and a corrugated tube 130 having one end side fixed to the connector cover 110.

Electric wires W are pulled out from a rear face side of the connector housing 102. The electric wires W pulled out from the connector housing 102 pass through an inside of the connector cover 110 and then are pulled outwardly through the inside of the corrugated tube 130.

The connector cover 110 includes a cover body 111, a first lid portion 121 and a second lid portion 122 which are coupled to a side portion of the cover body 111 via hinge portions 120. On inner face sides of the cover body 111 and second lid portion 122, there are provided tube lock protrusions 113, 123 respectively.

The connector housing 102 and the connector cover 110 are provided with a first lock member 140 and a second lock member 150.

The first lock member 140 includes a lock protruding portion (not shown) and lock protruding walls 142 which are provided on mutually opposing face sides of the connector housing 102, a lock dent portion 143 provided at the cover body 111, and a pair of lock arms 144 provided at the first lid portion 121. The lock protruding portion (not shown) of the connector housing 102 enters the lock dent portion 143 of the cover body 111, and the lock arms 144 of the first lid portion 121 are locked to the lock protruding walls 142 of the connector housing 102. By this, it is so locked as to prevent the connector cover 110 from being disengaged from the connector housing 102.

The second lock member 150 includes a plurality of lock frames 151 provided at the cover body 111 and lock arms 152 provided at the first lid portion 121 and the second lid portion 122. The respective lock arms 152 are locked to the corresponding lock frames 151. By this, the first lid portion 121 and the second lid portion 122 are locked to the cover body 111 in respective closing positions.

Next, the procedure for assembling the connector 100 will be explained. As shown in FIG. 2, the corrugated tube 130 is set on the electric wires W pulled out from the connector housing 102. Then, as shown in FIG. 4, the cover body 111 of the connector cover 110 is set in a mounting position of the connector housing 102. In setting to the mounting position, the lock protruding portion (not shown) of the connector housing 102 enters the lock dent portion 143 of the cover body 111. Transfer of the cover body 111 to the mounting position may be in any of the directions depicted by a solid line or an imaginary line in FIG. 3. Then, as shown in FIG. 4, the corrugated tube 130 is set in a mounting position of the cover body 111. Then, the first lid portion 121 and the second lid portion 122 are rotated around the hinge portions 120 as a fulcrum, and thereby are set to the respective closing positions. After the rotation of the first lid portion 121 and second lid portion 122 to the respective closing positions, the lock protruding walls 142 and the lock arms 144 are locked with each other while the respective lock arms 152 and the corresponding lock frame 151 are locked with each other. By this, the first lock member 140 and the second lock member 150 are locked (see FIG. 1). This completes the assembling.

However, in the conventional connector 100, after the cover body 111 of the connector cover 110 is set in the mounting position of the connector housing 102, it is necessary for an operator to hold the cover body 111 of the connector cover 110 in the mounting position of the connector housing 102 by hand and the like until the first lid portion 121 is rotated to the closing position. Thus, there was a problem that workability of the assembly was bad.

Here, it is conceivable to add a temporary lock member which temporarily locks the cover body 111 of the connector cover 110 at the mounting position of the connector housing 102 (for example, refer to PTL 1). However, the temporary lock member of the PTL 1 has such a structure that the lock arm is locked to a lock hole by an elastic deformation in the process where the cover body 111 is slidably inserted to the connector housing 102, and thus a lock holding force is low. Therefore, when a load is applied to the connector cover 110 mounted to the connector housing 102, there was a possibility that the connector cover 110 may easily drop off from the connector housing 102.

SUMMARY OF THE INVENTION

The present invention has been made to solve the above problem. It is an object of the present invention to provide a connector having a good workability in mounting a connector cover to a connector housing, and capable of preventing the connector cover from easily dropping off from the connector housing.

According to an aspect of the present invention, there is provided a connector including: a connector housing from which an electric wire is pulled out; a connector cover having a cover body and a lid portion, and mounted to an electric wire pulling-out side of the connector housing; a lock member configured to lock between the connector housing and the connector cover and between the cover body and the lid portion in a state where the cover body is aligned to a mounting position of the connector housing and the lid portion is aligned to a mounting position of the cover body; and a temporary lock member including: a mating arm provided at one member of the connector housing and the cover body, and an arm mating hole provided at the other member of the connector housing and the cover body, wherein the mating arm has an edge portion formed with a protruding portion, the arm mating hole is so configured that: from an insertion inlet to an insertion midway of the arm mating hole, the mating arm is inserted only in a direction oblique to a mounting direction of the other member; in a position where the protruding portion abuts an interference inner wall face of the arm mating hole, the other member is pressed inward while being rotated such that the other member returns to a position where the other member faces an inherent mounting direction of the other member, which allows the protruding portion to get over the interference inner wall face and to be inserted to an insertion completion position of the arm mating hole; and in the insertion completion position, the arm mating hole sandwiches the protruding portion, which allows the temporary lock member to lock between the connector housing and the cover body.

According to an aspect of the present invention, in the position where the protruding portion abuts the interference inner wall face, an externally visible outer interference portion of the connector housing and an externally visible outer interference portion of the cover body abut each other.

According to an aspect of the present invention, the temporary lock member serves as a part of the lock member.

According to the aspects of the present invention, setting the cover body of the connector cover in the mounting position of the connector housing allows locking of the cover body and the connector housing by the temporary lock member. Thus, it is not necessary for the operator to hold the cover body of the connector cover to the mounting position of the connector housing by hand and the like until the lid portion is set to the mounting position of the cover body. Further, the temporary lock member is not unlocked unless a straight releasing force and a rotary force are applied to between the cover body and the connector housing in a predetermined order, and therefore the temporary lock member can lock between the cover body and the connector housing by a strong locking force. As described above, workability in mounting the connector cover to the connector housing becomes good and the connector cover does not easily drop off from the connector housing.

DESCRIPTION OF THE EMBODIMENTS

An embodiment of the present invention will be described below referring to drawings.

Figure 1:
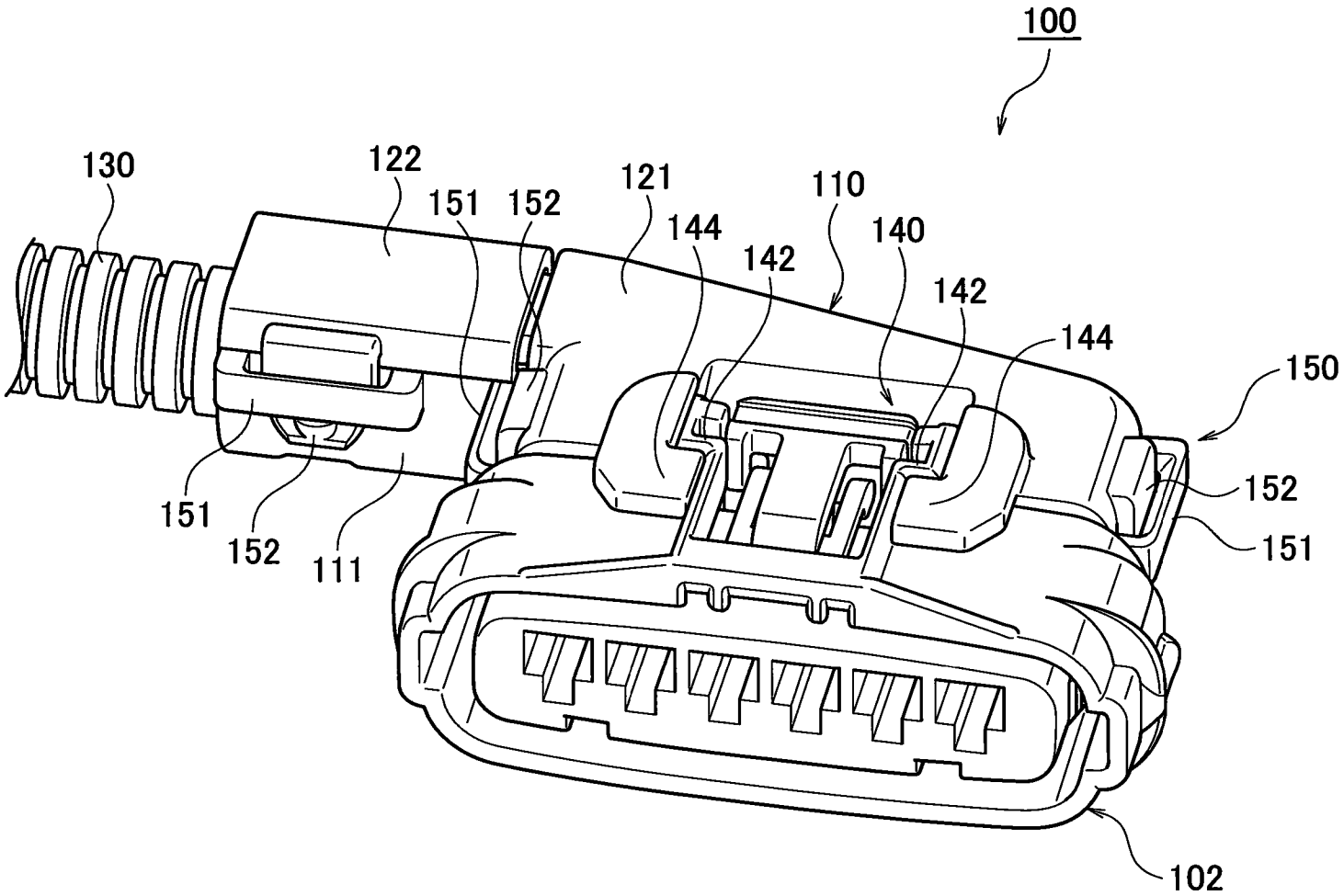
FIG. 1 is a perspective view of a conventional connector.
Figure 2:
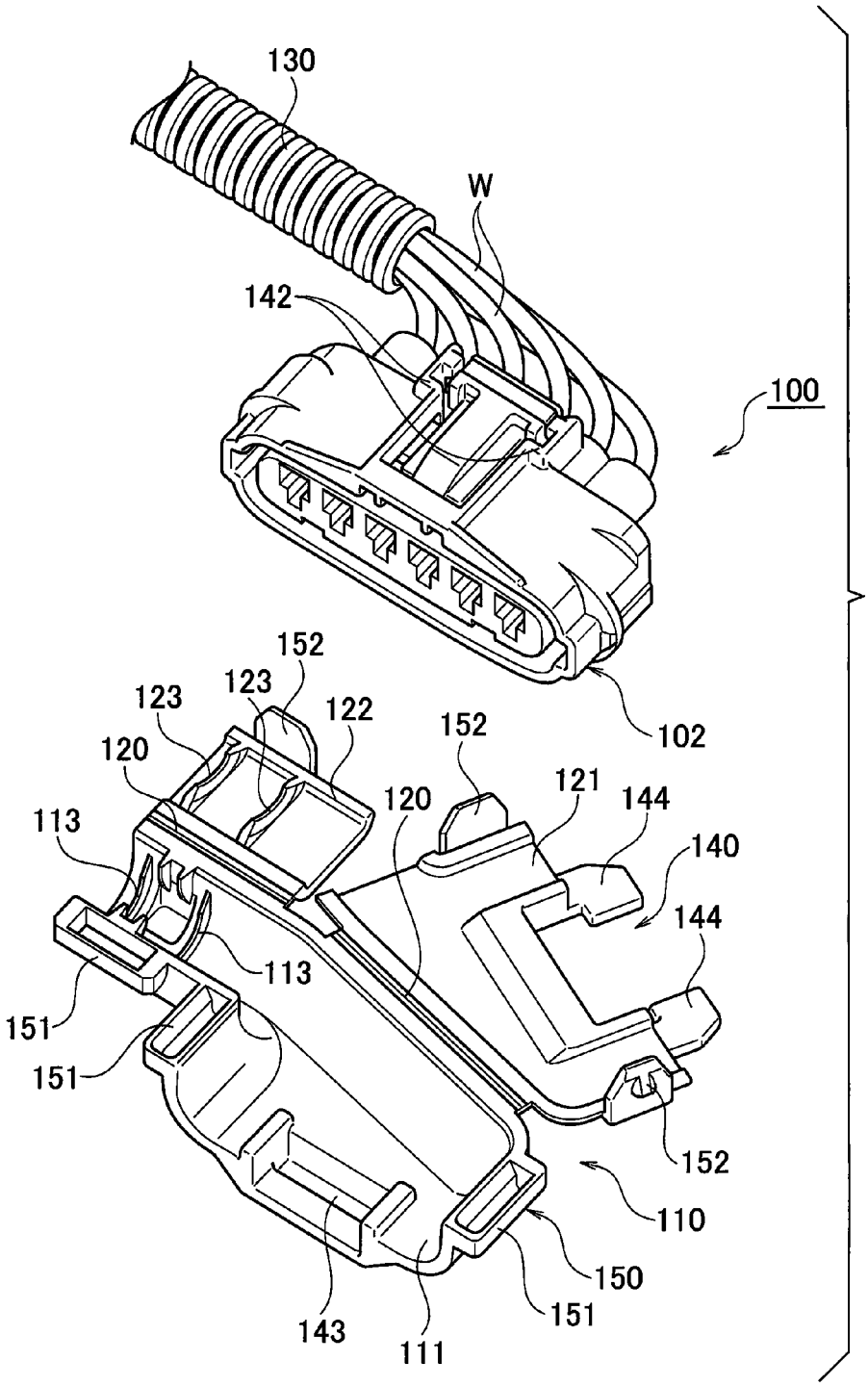
FIG. 2 is an exploded perspective view of the conventional connector viewed from an upper face side thereof.
Figure 3:
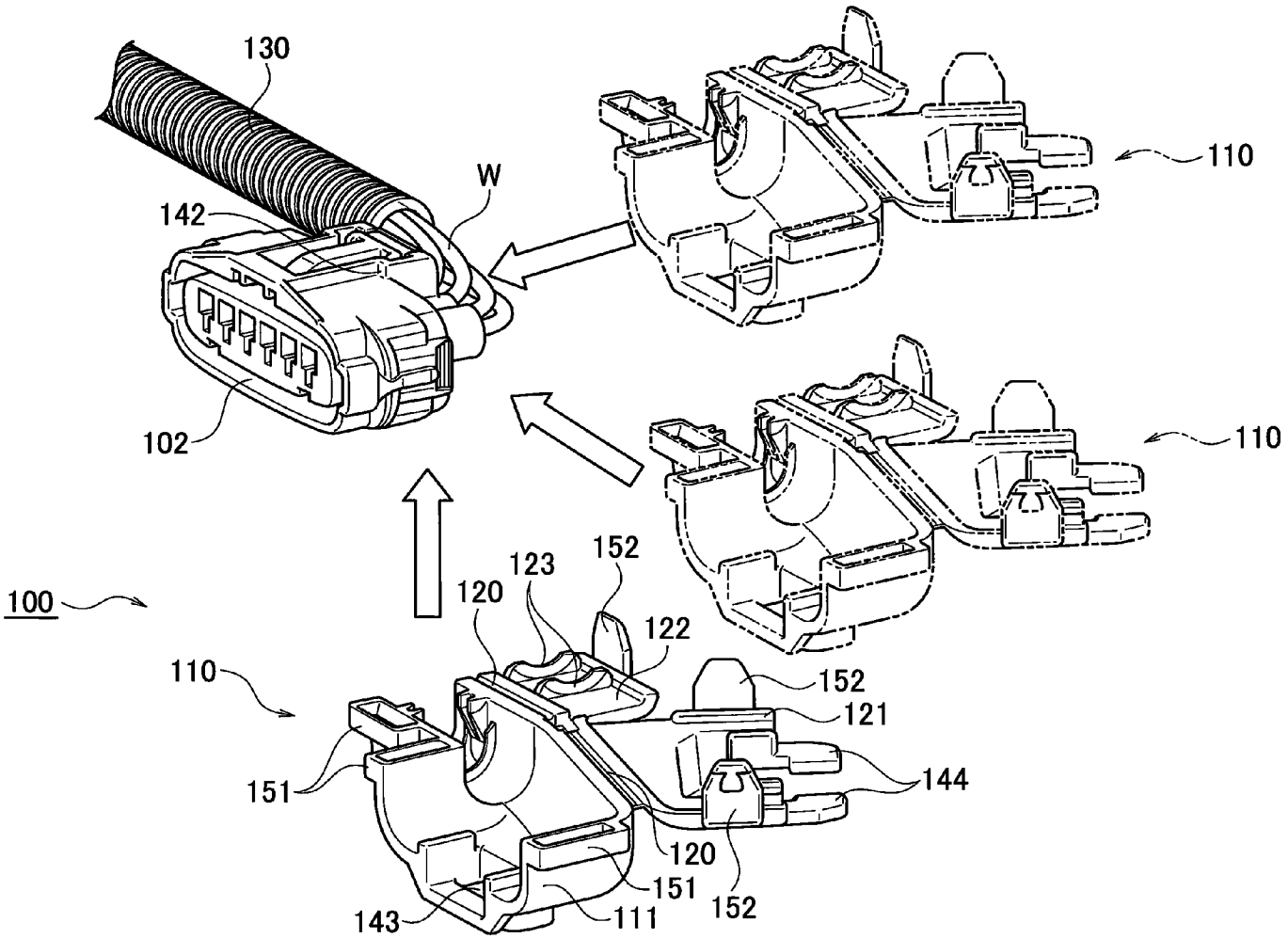
FIG. 3 is a perspective view that illustrates procedures for mounting a connector cover to a connector housing in the conventional connector.
Figure 4:
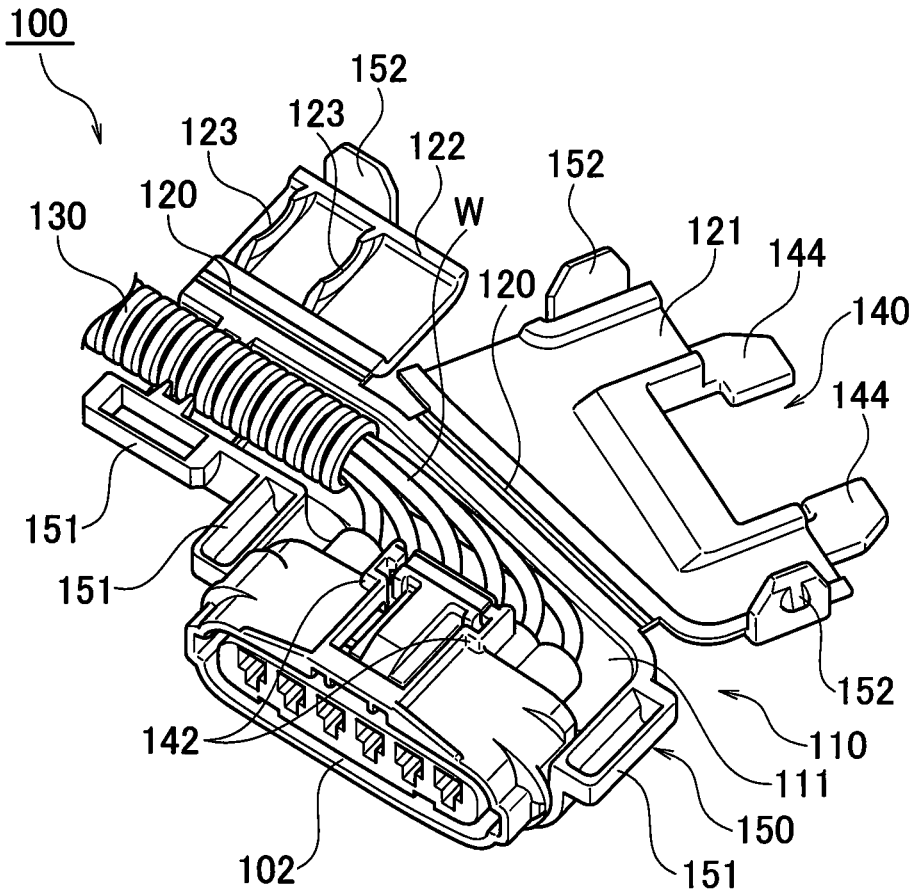
FIG. 4 is a perspective view of a state where a cover body of the connector cover is temporarily mounted to the connector housing in the conventional connector.
Figure 5:
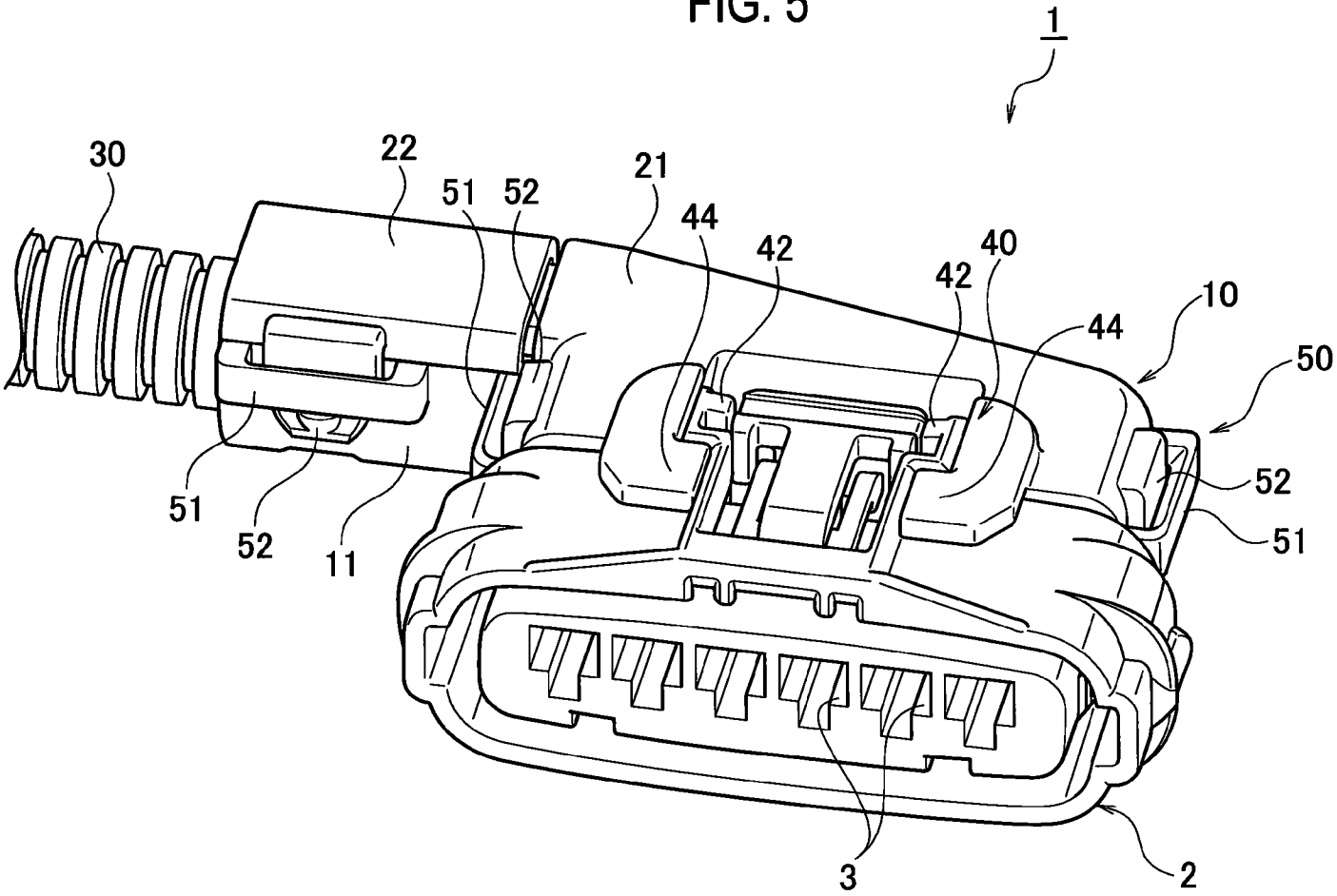
FIG. 5 is a perspective view of a connector according to an embodiment of the present invention.
Figure 6:
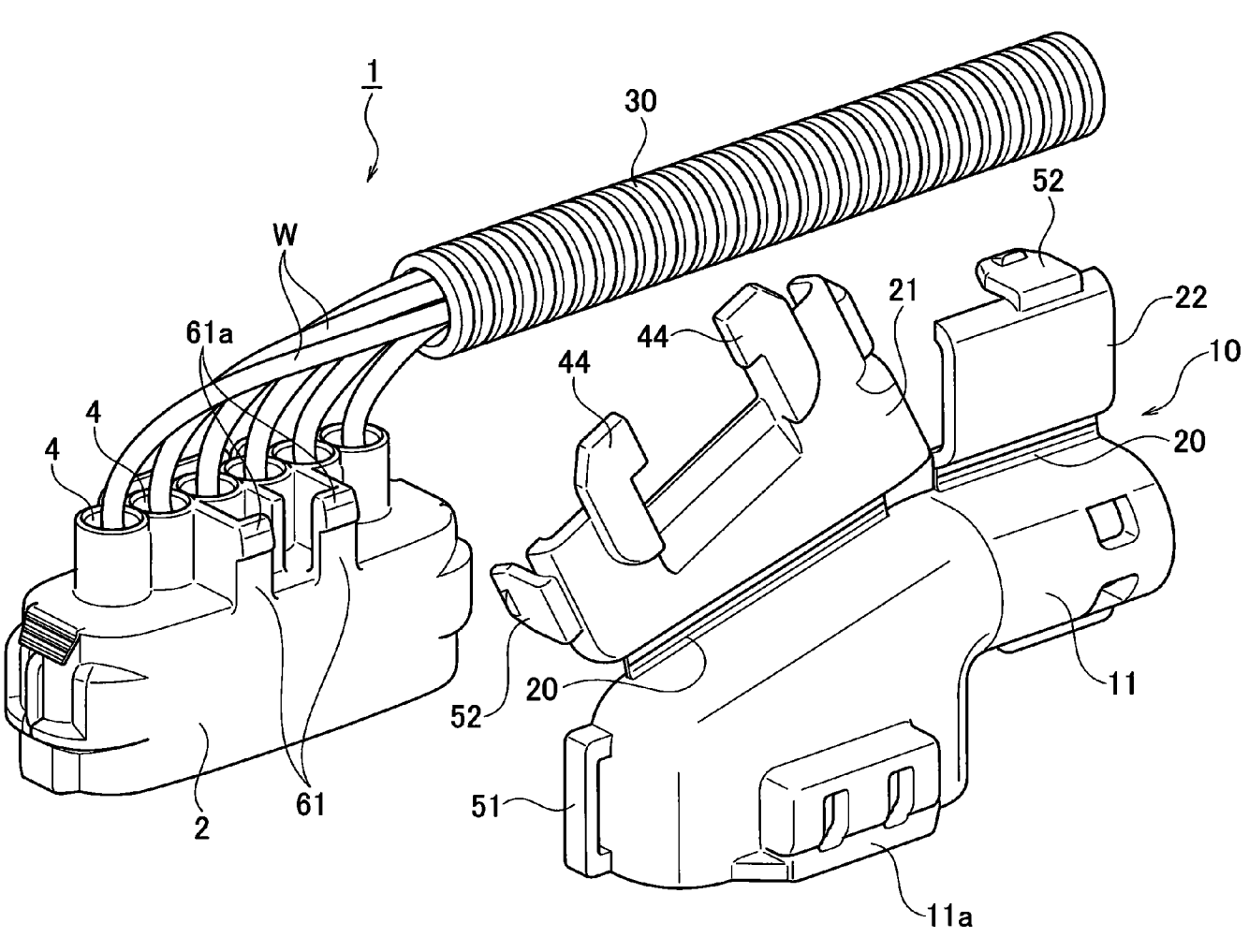
FIG. 6 is an exploded perspective view of the connector viewed from a bottom face side thereof according to the embodiment of the present invention.
Figure 7:
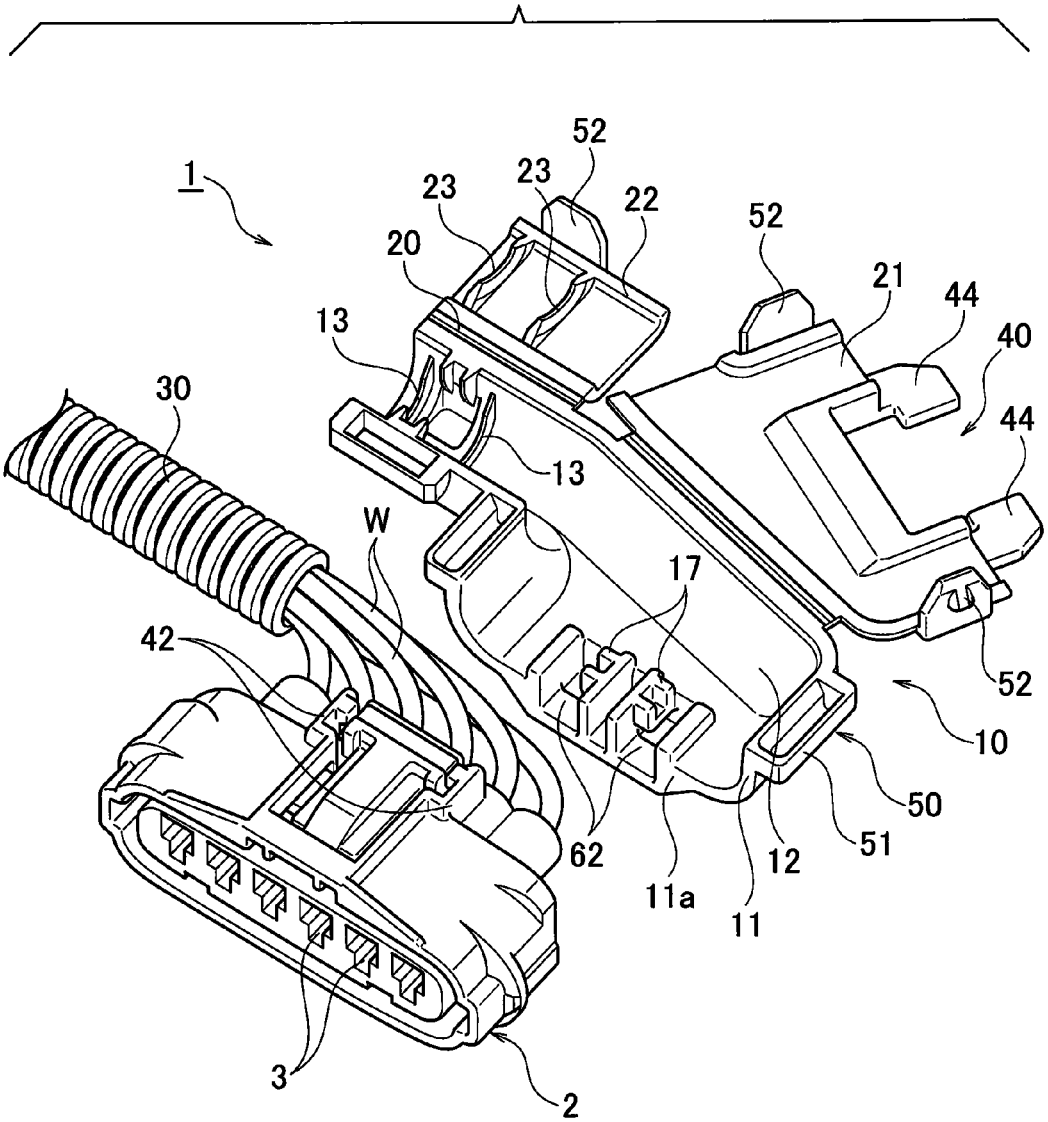
FIG. 7 is an exploded perspective view of the connector viewed from an upper face side thereof according to the embodiment of the present invention.
Figure 8:
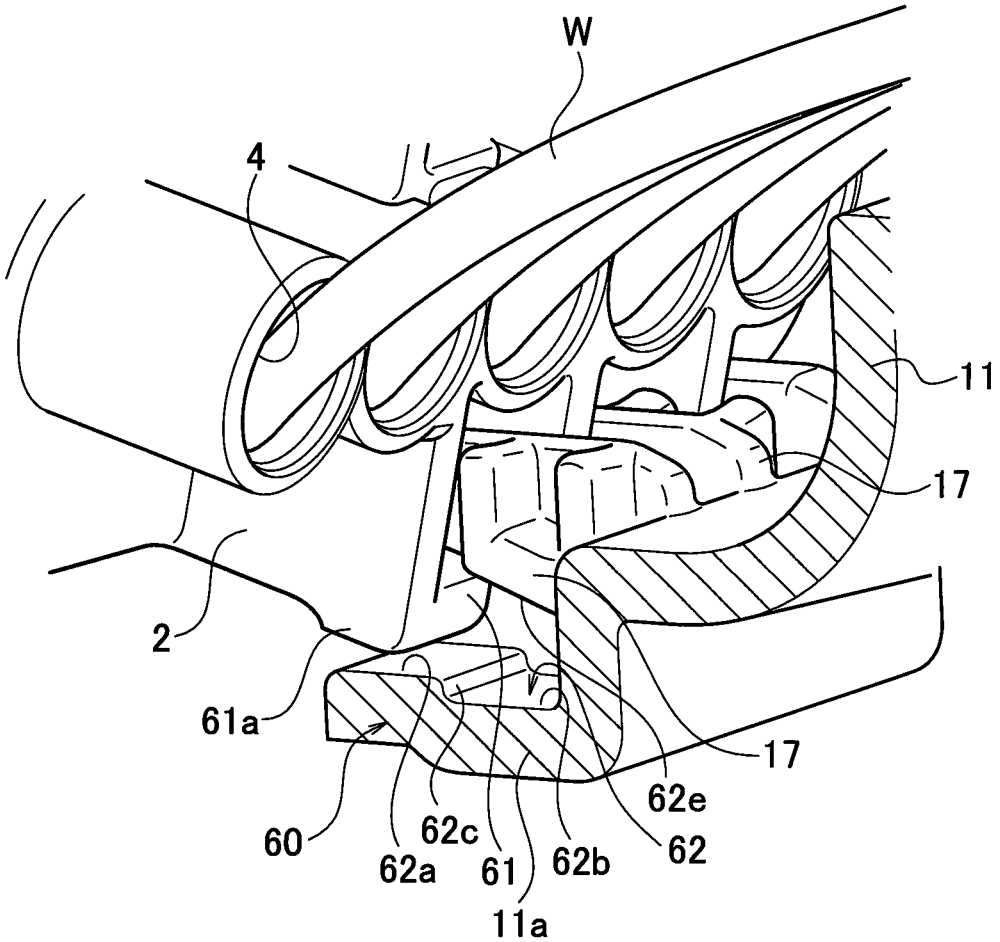
FIG. 8 is a perspective view of a temporary lock member in the connector according to the embodiment of the present invention.

FIG. 5 to FIG. 11B show the embodiment of the present invention. As shown in FIG. 5 to FIG. 7, a connector 1 includes a connector housing 2, a connector cover 10 mounted to the connector housing 2 and a corrugated tube 30 having one end side fixed to the connector cover 10.

The connector housing 2 has a plurality of terminal receiving chambers 3 each having a front face side opened. A terminal (not shown) is received in each of the terminal receiving chambers 3. A terminal of an electric wire W is connected to the terminal (not shown) received in each of the terminal receiving chambers 3. The electric wire W is pulled out from each of electric wire outlets 4 on a rear face of the connector housing 2.

The connector cover 10 includes a cover body 11, and a first lid portion 21 and a second lid portion 22 which are connected via respective hinge portions 20 to a side portion of the cover body 11.

The first lid portion 21 and the second lid portion 22 rotate around the respective hinge portions 20. By this, the first lid portion 21 and the second lid portion 22 open and close the inside of the cover body 11. A position for closing the inside of the cover body 11 is a mounting position. In the mounting position, an electric wire inserting passageway 12 is formed among the cover body 11, the first lid portion 21 and the second lid portion 22. The cover body 11 and the second lid portion 22 are respectively provided with tube lock protrusions 13 and tube lock protrusions 23, which lock one end side of the corrugated tube 30, in the electric wire inserting passageway 12. In a closing position of the second lid portion 22, the tube lock protrusions 13, 23 lock one end side of the corrugated tube 30.

The electric wires W pulled out from the connector housing 2 pass through the electric wire inserting passageway 12 of the connector cover 10 and are pulled outwardly through the inside of the corrugated tube 30.

Together with a first lock member 40 and a second lock member 50, a temporary lock member 60 is provided at the connector housing 2 and the connector cover 10.

The first lock member 40 includes a temporary lock member 60 (to be described in detail below), a pair of lock protruding walls 42 provided at the connector housing 2, and a pair of lock arms 44 provided at the first lid portion 21. That is, the temporary lock member 60 serves also as a part of the first lock member 40. The first lock member 40 makes a locking operation such that the connector cover 10 does not drop off from the connector housing 2.

The second lock member 50 includes lock frames 51 provided at the cover body 11 and lock arms 52 provided at the first lid portion 21 and second lid portion 22. The respective lock frames 51 and the corresponding lock arms 52 are locked with each other by an elastic deformation. The second lock member 50 makes a locking operation such that the first and second lid portions 21, 22 in the respective closing positions do not rotate in the opening direction relative to the cover body 11.

The temporary lock member 60 includes, as shown in detail in FIG. 8 to FIG. 11B, two mating arms 61 provided at the connector housing 2 and two arm mating holes 62 provided at the cover body 11.

The two mating arms 61 are disposed in parallel with each other at a certain interval. Each of the mating arms 61 has an edge portion provided with a protruding portion 61*a*. The protruding portion 61*a* is formed such that the edge portion of the mating arm 61 protrudes more downward than a root portion of the mating arm 61.

The two arm mating holes 62 are respectively formed by utilizing the space between protruding wall portions 11*a* of the cover body 11 and two ribs 17 provided at a certain interval inside the protruding wall portions 11*a*. An inner face on the protruding wall portion 11*a* side of each arm mating hole 62 is formed into a section from an insertion inlet to an insertion midway of the arm mating hole 62 as an interference inner wall face 62*a*, a section from the insertion midway to an insertion completion position as a sandwiching inner wall face 62*b*, and an area between the interference inner wall face 62*a* and the sandwiching inner wall face 62*b* as a step face 62*c*. An inner face on the rib 17 side of the arm mating hole 62 is formed into a section from the insertion inlet of the arm mating hole 62 to a position slightly inward than the interference inner wall face 62*a* as a taper face 62*d*, and a section from the end of the taper face 62*d* to a position inward of the taper face 62*d* as a straight sandwiching inner wall face 62*e*. The taper face 62*d* has the largest area on the insertion inlet side and is so inclined inward as to become narrower.

With the above structure, in the insertion of the mating arm 61, the arm mating hole 62 is so formed, that (1) in the section from the insertion inlet to the insertion midway, the mating arm 61 is inserted only in a direction oblique to a mounting direction of the cover body 11 in a position where the cover body 11 is inclined with respect to an inherent mounting direction of the cover body 11, and (2) in a position where the protruding portion 61*a* abuts the interference inner wall face 62*a*, the cover body 11 is pressed inward while being rotated such that the cover body 11 returns to a position where the cover body 11 faces the inherent mounting direction of the cover body 11, which allows the protruding portion 61*a* to get over an interference with the interference inner wall face 62*a* by a compression deformation and to be sandwiched and locked by a pair of the sandwiching inner wall faces 62*b*, 62*e*.

Figure 10A:
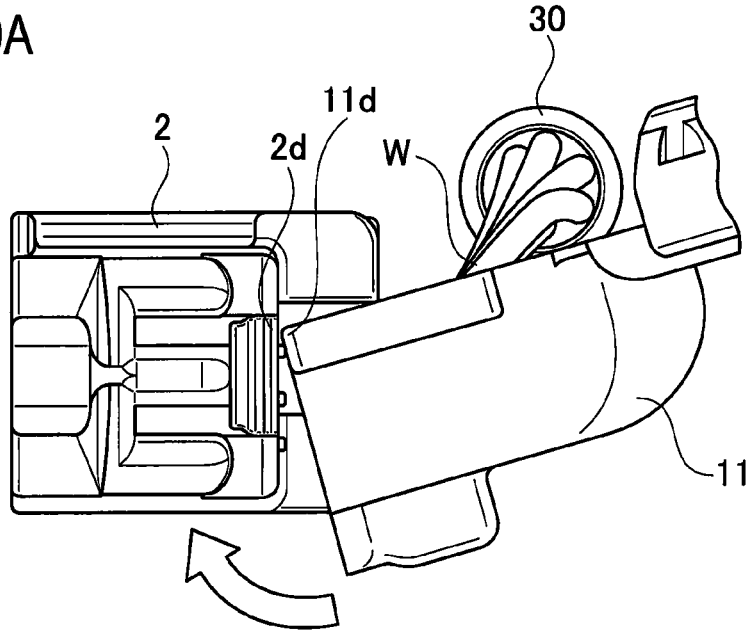
FIG. 10A is a side view that illustrates procedures for mounting the connector cover to the connector housing in the connector according to the embodiment of the present invention.

Further, in the position where the protruding portion 61*a* abuts the interference inner wall face 62*a*, as shown in FIG. 10A, it is so configured that an externally visible outer interference portion 2*d* of the connector housing 2 and an externally visible outer interference portion 11*d* of the cover body 11 abut each other.

Figure 9A:
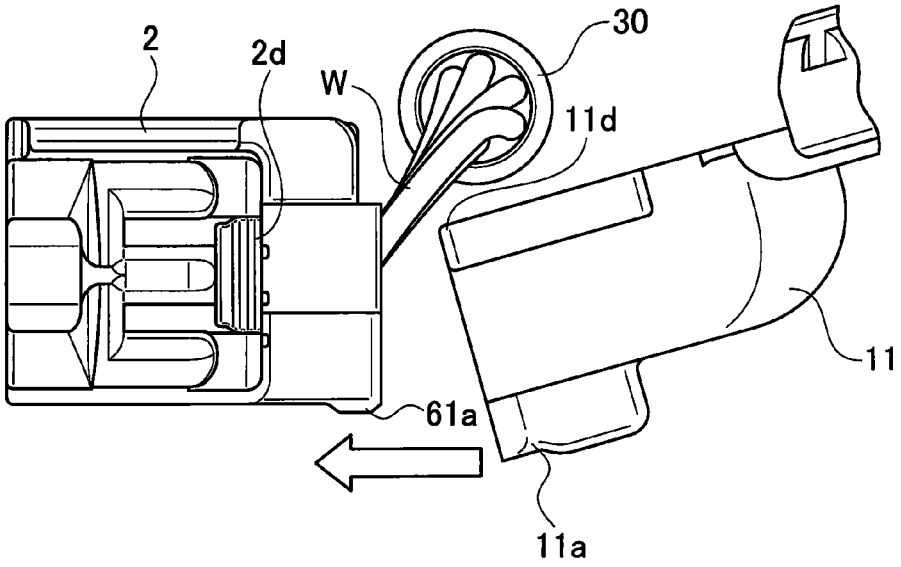
FIG. 9A is a side view that illustrates procedures for mounting a connector cover to a connector housing in the connector according to the embodiment of the present invention.
Figure 9B:
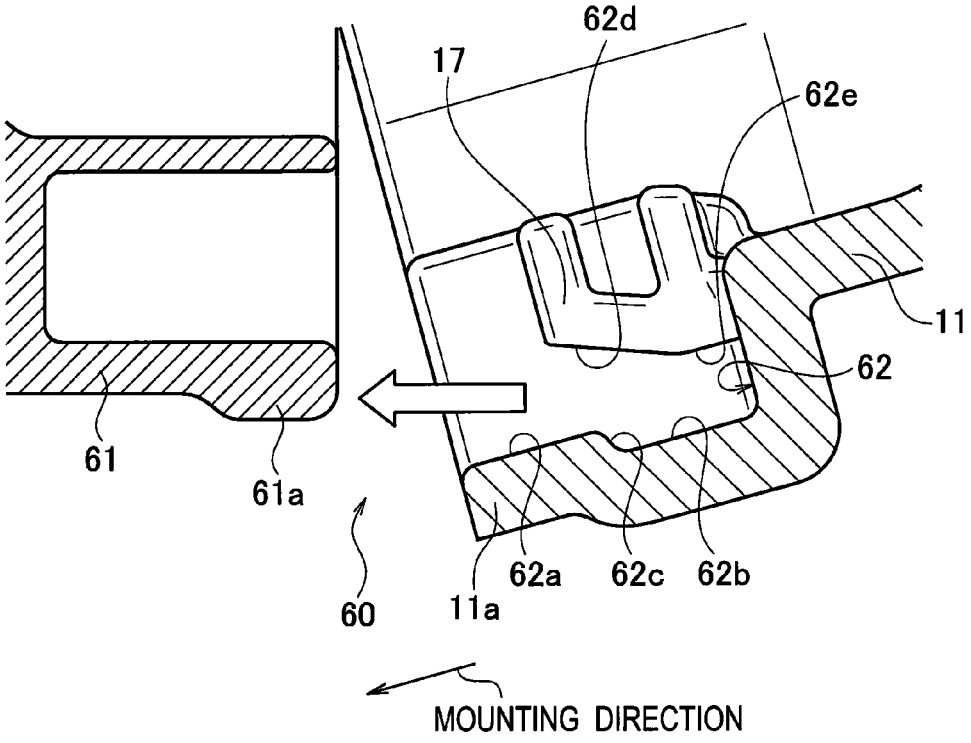
FIG. 9B is a cross-sectional view of essential portions that illustrates procedures for mounting the connector cover to the connector housing according to the embodiment of the present invention.
Figure 10B:
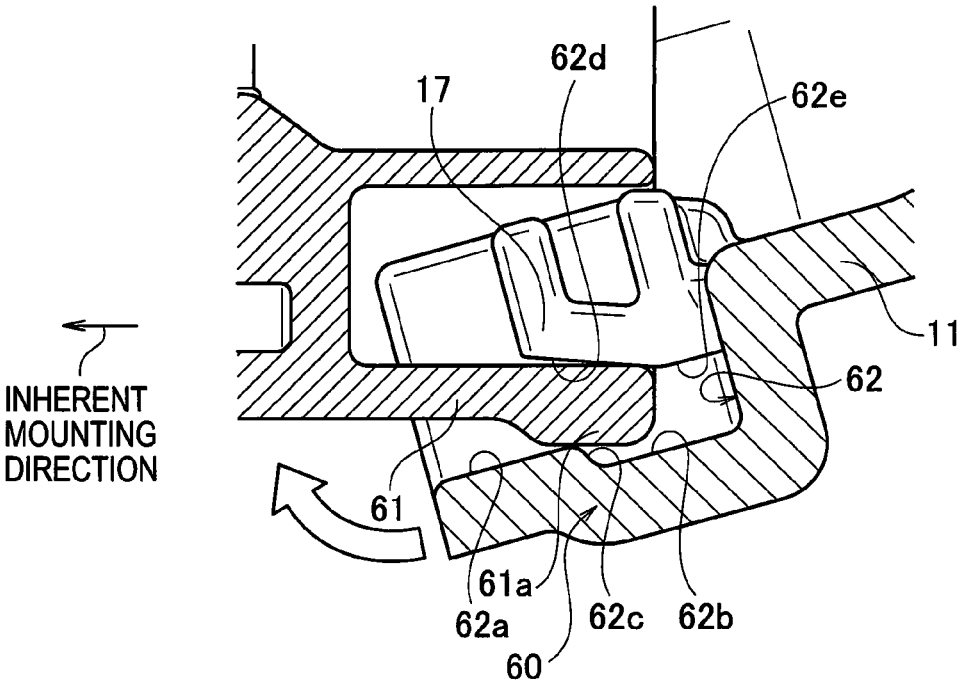
FIG. 10B is a cross-sectional view of essential portions that illustrates procedures for mounting the connector cover to the connector housing in the connector according to the embodiment of the present invention.

Next, an assembling procedure of the connector 1 will be explained. The corrugated tube 30 is set on the electric wires W pulled out from the connector housing 2. Next, as shown in FIGS. 9A, 9B, the cover body 11 of the connector cover 10 is set in an inherent mounting position of the connector housing 2. Here, the cover body 11 is so operated as to approach the connector housing 2 obliquely relative to a mounting direction of the connector housing 2, and the mating arm 61 of the connector housing 2 is inserted into the arm mating hole 62 of the cover body 11. Then, as shown in FIGS. 10A, 10B, the protruding portion 61*a* of the mating arm 61 abuts the interference inner wall face 62*a* of the arm mating hole 62. In this insertion position, the outer interference portion 2*d* of the connector housing 2 abuts the outer interference portion 11*d* of the cover body 11. By this, in the insertion in the straight direction of the cover body 11, the cover body 11 cannot be inserted to the connector housing 2 any further.

Figure 11A:
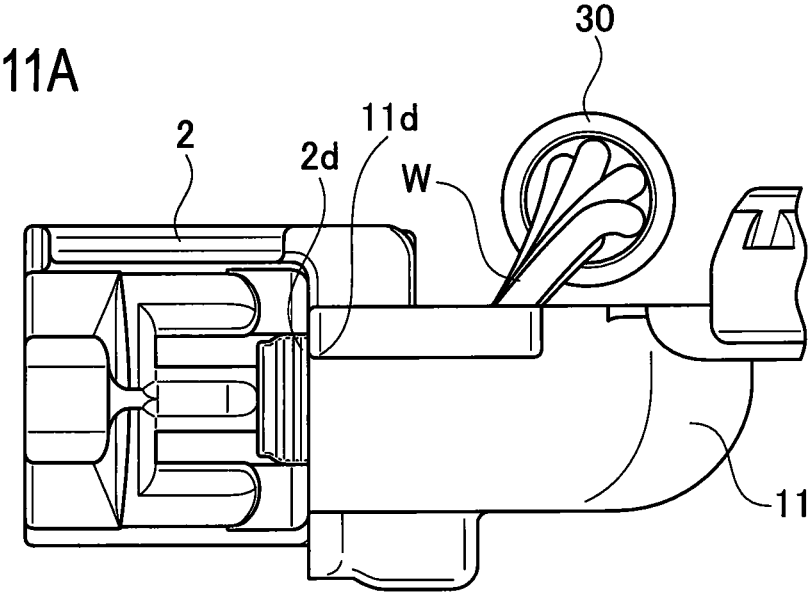
FIG. 11A is a side view that illustrates procedures for mounting the connector cover to the connector housing in the connector according to the embodiment of the present invention.
Figure 11B:
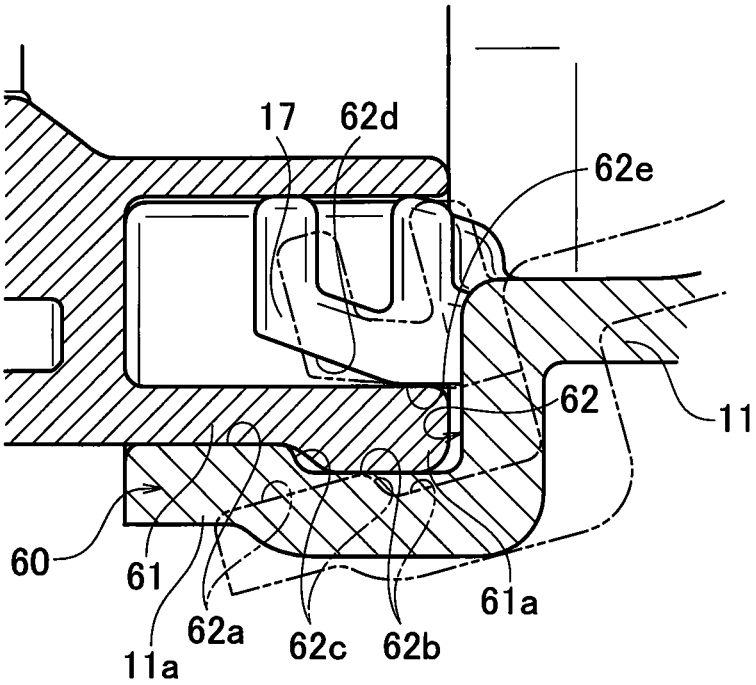
FIG. 11B is a cross-sectional view of essential portions that illustrates procedures for mounting the connector cover to the connector housing in the connector according to the embodiment of the present invention.

Next, as depicted by an arrow in FIG. 10B, the cover body 11 is pressed inward while being rotated such that the cover body 11 returns to a position where the cover body 11 faces the inherent mounting direction of the cover body 11. This allows the protruding portion 61*a* of the mating arm 61 to get over the interference inner wall face 62*a* by the compression deformation, and allows the mating arm 61 to be inserted to the insertion completion position of the arm mating hole 62. By this, as shown in FIGS. 11A and 11B, the protruding portion 61*a* of the mating arm 61 is sandwiched by a pair of the sandwiching inner wall faces 62*b*, 62*e* of the arm mating hole 62. By this, the cover body 11 is temporarily locked to the connector housing 2.

Next, the electric wires W are disposed in the electric wire inserting passageway 12 of the cover body 11 and one end side of the corrugated tube 30 is set at the tube lock protrusion 13 of the cover body 11.

Next, the first lid portion 21 and the second lid portion 22 are rotated around the hinge portions 20 to the closing position (mounting position) of the cover body 11. Then, the respective lock protruding walls 42 of the first lock member 40 and the corresponding lock arms 44 of the first lock member 40 are locked with each other. Here, the temporary lock member 60 as a part of the first lock member 40 is already in the lock position. Further, the respective lock arms 52 of the second lock member 50 and the corresponding lock frames 51 of the second lock member 50 are locked with each other. By this, the connector housing 2 is locked with the connector cover 10, the cover body 11 is locked with the first and second lid portions 21 and 22, and the connector cover 10 is locked with the corrugated tube 30 (refer to FIG. 5). This completes the assembling.

As set forth above, the connector 1 includes the temporary lock member 60 having the mating arm 61 provided at the connector housing 2 and the arm mating hole 62 provided at the cover body 11. The edge portion of the mating arm 61 is formed with the protruding portion 61*a*. The arm mating hole 62 has such a structure that: (1) from the insertion inlet to the insertion midway, the mating arm 61 is inserted only in the direction oblique to the mounting direction of the cover body 11; (2) in the position where the protruding portion 61*a* abuts the interference inner wall face 62*a*, the cover body 11 is pressed inward while being rotated such that the cover body 11 returns to a position where the cover body 11 faces the inherent mounting direction of the cover body 11, which allows the protruding portion 61*a* to get over the interference inner wall face 62*a* and to be inserted to the insertion completion position; and (3) in the insertion completion position, the temporary lock member 60 sandwiches the protruding portion 61*a* and locks between the connector housing 2 and the cover body 11. Thus, setting the cover body 11 in the mounting position of the connector housing 2 allows locking of the cover body 11 and the connector housing 2 by the temporary lock member 60. Therefore, it is not necessary for the operator to hold the cover body 11 of the connector cover 10 to the mounting position of the connector housing 2 by hand and the like until the first lid portion 21 and second lid portion 22 are set in the mounting position of the of the cover body 11. Further, the temporary lock member 60 does not become unlocked unless a straight releasing force and a rotary force are applied to between the cover body 11 and the connector housing 2 in a predetermined order, and therefore the temporary lock member 60 can lock between the cover body 11 and the connector housing 2 by a strong locking force. As described above, workability in mounting the connector cover 10 to the connector housing 2 is good and the connector cover 10 does not easily drop off from the connector housing 2.

In the position where the protruding portion 61*a* abuts the interference inner wall face 62*a*, the externally visible outer interference portion 2*d* of the connector housing 2 and the externally visible outer interference portion lid of the cover body 11 abut each other. Thus, in the mounting process of the connector cover 10, the timing at which the mating arm 61 is obliquely inserted, followed by pressing the cover body 11 inward while rotating the cover body 11 can be clearly recognized, thereby improving the workability in mounting.

The temporary lock member 60 serves also as a part of the first lock member 40. Thus, with the connector 1 having the lock member (the first lock member 40 and the second lock member 50 according to this embodiment) and the temporary lock member 60, complicating the structure can be prevented as much as possible.

Further, according to the embodiment, the temporary lock member 60 has the mating arm 61 provided at the connector housing 2 and the arm mating hole 62 provided at the cover body 11; however, the arm mating hole 62 may instead be provided at the connector housing 2 and the mating arm 61 may be provided at the cover body 11.

What is claimed is:

1. A connector comprising:

a connector housing from which an electric wire is pulled out;

a connector cover having a cover body and a lid portion, and mounted to an electric wire pulling-out side of the connector housing;

a lock member configured to lock between the connector housing and the connector cover and between the cover body and the lid portion in a state where the cover body is aligned to a mounting position of the connector housing and the lid portion is aligned to a mounting position of the cover body; and a temporary lock member including:

a mating arm provided at one member of the connector housing and the cover body, and an arm mating hole provided at the other member of the connector housing and the cover body, wherein:

the mating arm has an edge portion formed with a protruding portion, the arm mating hole is so configured that:

from an insertion inlet to an insertion midway of the arm mating hole, the mating arm is inserted only in a direction oblique to amounting direction of the other member;

in a position where the protruding portion abuts an interference inner wall face of the arm mating hole, the other member is pressed inward while being rotated such that the other member returns to a position where the other member faces an inherent mounting direction of the other member, which allows the protruding portion to get over the interference inner wall face and to be inserted to an insertion completion position of the arm mating hole; and in the insertion completion position, the arm mating hole sandwiches the protruding portion, which allows the temporary lock member to lock between the connector housing and the cover body.

2. The connector according to claim 1, wherein in the position where the protruding portion abuts the interference inner wall face, an externally visible outer interference portion of the connector housing and an externally visible outer interference portion of the cover body abut each other.

3. The connector according to claim 1, wherein the temporary lock member serves as a part of the lock member.

* * * * *